US005477627A

United States Patent [19]

Nolin et al.

[11] Patent Number: 5,477,627

[45] Date of Patent: Dec. 26, 1995

[54] METHOD AND APPARATUS FOR HARVESTING AND DEWATERING PEAT MOSS MATERIAL

[75] Inventors: Richard Nolin, Repentigny; John Dery, Montreal, both of Canada

[73] Assignee: Johnson & Johnson Inc., Quebec, Canada

[21] Appl. No.: 435,236

[22] Filed: May 5, 1995

Related U.S. Application Data

[63] Continuation of Ser. No. 42,037, Apr. 2, 1993, abandoned.

[30] Foreign Application Priority Data

Apr. 13, 1992 [CA] Canada ..... 2065923

[51] Int. Cl.[6] ..... E21C 49/00

[52] U.S. Cl. ..... 37/3; 37/444; 56/DIG. 23

[58] Field of Search ..... 37/3, 319, 340, 37/341, 443, 444, 447, 901, 903, 445, 426; 171/44, 56, 111, 122, 126, 132, 133, 135; 56/8, 16.5, 155, 293, 432, 489, DIG. 1, DIG. 23; 210/770

[56] References Cited

U.S. PATENT DOCUMENTS

| | | | |
|---|---|---|---|
| 2,200,137 | 5/1940 | Steinert | 37/3 |
| 2,397,363 | 3/1946 | McLeod | 37/3 X |
| 2,658,290 | 11/1953 | Pierce | 37/3 |
| 3,143,227 | 8/1964 | Wiemann | 37/901 |
| 4,144,980 | 3/1979 | Meyer | 37/901 |
| 4,248,033 | 2/1981 | Bryant | 56/8 |
| 4,349,308 | 9/1982 | Buckstead et al. | 37/901 |
| 4,516,896 | 5/1985 | Freeberry | 37/406 X |
| 4,861,433 | 8/1989 | Eriksson | 162/323 |
| 4,912,914 | 4/1990 | Wingard | 56/DIG. 23 X |

FOREIGN PATENT DOCUMENTS 3402269 1/1985 Germany .

OTHER PUBLICATIONS

Bengt Jonsson, Eva Petersson, Bjorn Lindman, "Mechanical Dewatering of Peat", Jun. 1987.

Bradley A. James and Patrick W. Kane, "Sludge Dewatering and Incineration at Westvaco, North Charleston, S.C.", May 1991.

Baler Equipment Co., "BECO Model 1000 Separator", [no date given].

Outomec, "Capillary–Action Ceramic Dewatering", [no date given].

FKC America, Inc., "FKC Screw Press", [no date given].

Kamyr, "Ring Press", [no date given].

*Primary Examiner*—Dennis L. Taylor
*Assistant Examiner*—Spencer Warnick
*Attorney, Agent, or Firm*—James P. Barr

[57] ABSTRACT

An attachment mounted to an articulated boom of a carrier vehicle for harvesting and dewatering peat moss material. The attachment comprises an apertured bucket for digging peat moss material and a ram movable with relation to the bucket between an extended position and a retracted position. The ram and the bucket define a variable volume press chamber which is contractible in response to movement of the ram member toward the extended position for expressing water from the load of peat moss material gathered in the bucket. The invention also extends to a novel method for harvesting and dewatering peat moss material.

23 Claims, 7 Drawing Sheets

METHOD AND APPARATUS FOR HARVESTING AND DEWATERING PEAT MOSS MATERIAL

This is a continuation, of application Ser. No. 08/042,037, filed Apr. 2, 1993 now abandoned.

FIELD OF THE INVENTION

The invention relates to a novel method and apparatus for harvesting and dewatering peat moss material. The objective of the dewatering operation is to achieve a significant weight reduction of the peat moss crop to render more cost-effective its transportation and handling.

BACKGROUND OF THE INVENTION

The prior art has recognized the potential of peat moss material for use as an absorbent medium in structures for absorbing body exudate, such as sanitary napkins. The peat moss material has highly desirable fluid absorption properties, such as a remarkable absorption capacity and the ability of "drying" adjoining materials by continuing to pull or wick fluid away from them over a long time period such that virtually all fluid is collected in the peat moss core. These attributes allow the material to provide highly efficient absorbent components which can be made relatively thin for better fit, comfort and discretion, while being sufficiently absorbent to prevent overflow leakage and garment staining.

The following United States Patents document the use of peat moss material for manufacturing absorbent components for disposable absorbent products:

| U.S. Pat. No. | INVENTOR(s) | DATE ISSUED |
|---|---|---|
| 4,170,515 | Lalancette et al. | October 9, 1979 |
| 4,215,692 | Levesque | August 5, 1980 |
| 4,226,237 | Levesque | October 7, 1980 |
| 4,305,393 | Nguyen | December 15, 1981 |
| 4,473,440 | Ovans | September 25, 1984 |
| 4,507,122 | Levesque | March 26, 1985 |
| 4,618,496 | Brasseur | October 21, 1986 |
| 4,676,871 | Cadieux et al. | June 30, 1987 |
| 4,992,324 | Dubé | February 12, 1991 |
| 5,053,029 | Yang | October 1, 1991 |

The subject matter of these patents is incorporated herein by references.

Peat moss is a plant which grows from the top while the bottom part of the plant dies and gradually decomposes into peat. The modified VON POST method of characterizing the degree of decomposition of peat moss strata is the art accepted field test, described in detail in the "Peat Bogs of the Inhabited part of Roberval, Lac St-Jean, Dubuc and Chicoutimi Countries", a publication of the Ministére des Richesses Naturelles du Québec, Direction générale des Mines, authored by Antoine Simard, Québec, 1974. The subject matter of this publication is incorporated herein by reference.

As it is well known, peat moss beds, commonly referred to as peat bogs, typically have a vertical cross-sectional stratification. The top most layer of the bog is comprised of leaves, branches and flowers of living flora, predominantly the living peat moss plant but also including other plants growing on the bog. The top most layer extends to a depth in the range from about 2.5 centimeters to about 18 centimeters.

Below the topmost layer is a first intermediate layer consisting of undecomposed dead peat moss including the roots of other living plants. The first intermediate layer is characterized by being fibrous, relatively light coloured, with the plant structure generally intact. Such a layer extends typically from a depth in the range from about 35 centimeters to about 1 meter below the surface.

Below the first intermediate layer is located a second intermediate layer of partially decomposed peat moss which can generally be distinguished from the first intermediate layer by a clear line of colour demarcation. The second intermediate layer is characterized by increasingly darkening colour and increasing plant structure degradation as the depth increases, to a point where the plant structure is no longer apparent and it shades from brown to black. The lower portion of the second intermediate layer is typically a portion of the peat bog utilized as fuel. This layer extends from a depth in the range from about 1 meter to about 2.5 meters from the surface.

Below the second intermediate layer is the bottom layer which is the last stage of decomposition of the peat moss plant. The bottom layer is commonly referred to as "black earth" and is characterized by having essentially no discernable plant structure and a black colour. This material is found at a depth in the range from about 2.5 meters to about 4 meters from the surface. In some instances, peat bogs do not comprise this layer.

The modified VON POST scale assigns values to each stratum of the peat bog, from H-1 to H-4 with increasing degree of decomposition. The test consists of pressing samples of each peat moss stratum and examining the expelled water. An H-1 value is assigned to the top most layer which releases a clear liquid. An H-2 value is assigned to the first intermediate layer which releases a dirty liquid but substantially free of large organic particles. An H-3 value is assigned to the second intermediate layer containing peat moss in an advanced stage of decomposition, which when compressed, expels a muddy water containing brown and black organic particles. Finally, an H-4 value is assigned to the bottom layer which when pressed in the hand freely flows through the fingers.

Peat moss material for use in manufacturing absorbent components for disposable absorbent products is harvested from the peat moss bed and baled into blocks which are transported to the processing site where the peat moss material is refined and converted into absorbent material in continuous sheet form, the so-called "board". In a board form, the peat moss absorbent can be directly processed in high speed automatic equipment to assemble the disposable absorbent products.

To reduce transportation costs and facilitate the handling of the peat moss bales, it is desirable to dewater the peat moss material immediately after the harvesting operation in order to reduce its weight. One possibility is to provide at the harvesting site a mechanical press for compacting the peat moss crop and forcibly expel water absorbed in its fibers. However, the industry has always questioned the feasibility and the practicality of this dewatering technique on the grounds that peat moss material is a natural absorbent having excellent fluid retention properties and it is difficult to dewater by mechanical means.

OBJECTS AND SUMMARY OF THE INVENTION

An object of the present invention is an apparatus for harvesting peat moss material from a peat moss bed, that is capable of mechanically expelling a significant amount of water absorbed in the peat moss fibers for the purpose of reducing the weight of the peat moss material.

Another object of the invention is a method for harvesting peat moss material and mechanically dewatering same for reducing the weight of the peat moss crop.

As embodied and broadly described herein, the invention provides a device for harvesting and mechanically dewatering (for the purpose of this specification, "dewatering" shall mean a partial reduction of the water content of the peat moss material) peat moss material, the device comprising:

a supporting structure; and an apertured container mounted to the supporting structure and defining a variable volume press chamber, the container being capable to assume an expanded position and a contracted position in order to expand and contract the press chamber respectively, in the expanded position the container being in an opened condition allowing ingress of peat moss material in the press chamber, in the contracted position the container being in a substantially closed condition (in this specification, the container will be described as "closed" when it forms a confining barrier preventing the load of peat moss material to freely egress the press chamber, without necessarily forming a hermetically sealed enclosure due to the presence of apertures for water drainage purposes) preventing peat moss material to freely egress the press chamber and the press chamber having a significantly smaller volume than when the container is in the expanded position, whereby in the expanded position the container is capable of digging peat moss material from a peat moss bed, consequent movement of the container toward the contracted position causing a significant volume reduction of the press chamber for expressing water from peat moss material therein, which is drained from the press chamber through apertures on the container.

The principal advantage of the device according to the invention is its simplicity of construction derived by integrating into a single unit the harvester and the press, whereby the peat moss material can be gathered and dewatered in a cost-effective manner without the necessity of performing complex and time consuming manipulations.

Another surprising result is the impressive weight and size reduction of the peat moss material accomplished by expelling water from its fibers by the application of mechanical pressure. In some instances, a weight reduction of up to 50% can be achieved along with an appreciable size reduction of the peat moss bale.

Preferably, the harvesting and dewatering device is in the form of an attachment which is mounted to the end of an articulated boom of a carrier vehicle of the type used in common earth excavating machines. The boom allows to automatically maneuver the attachment into the desired position for conveniently digging peat moss material.

In a most preferred embodiment, the container which defines the press chamber is constituted by a pair of mating members which are movable one with relation to the other in order to selectively vary the press chamber volume. More specifically, the container comprises a bucket member stationary with relation to the supporting structure of the device and a ram member movable between an extended position and a retracted position. When the ram member is in the retracted position, the bucket member is open and it is capable to dig peat moss material from the peat moss bed. When the bucket member is filled with peat moss material, the dewatering cycle is initiated by advancing the ram member toward the bucket member. In a partially extending position, the ram member closes the bucket for preventing the peat moss material therein to freely egress the press chamber. By fully extending the ram member, the press chamber is contracted to expel water from the peat moss material while maintaining the press chamber in the closed position.

Preferably, the bucket and the ram member define a shearing assembly to cut and free the peat moss material gathered in the bucket from adjoining vegetation. The ram and bucket members form cooperating, opposing blades which shear the peat moss extending across the entry opening of the bucket member, when the ram member moves toward the extended position to execute the dewatering cycle.

Preferably, the device for harvesting and dewatering peat moss material has an ejector assembly for driving out of the bucket member the compressed load of peat moss material. The ejector assembly includes a projecting member such as the piston rod of a fluid-operated piston-cylinder assembly selectively movable across the press chamber to eject the dewatered peat moss material through the opening of the bucket member.

Advantageously, the drainage apertures on the container have an individual cross-sectional area in the range from about 0.32 square centimeters to about 2.85 square centimeters. Most preferably, the drainage apertures have an individual cross-sectional area of approximately 1.27 square centimeters and are spaced apart by a distance of approximately 1.91 centimeters. To most efficiently drain the press chamber, the number and the cross-sectional area of the apertures should be such as to provide on the container an open area in the range from about 25% to about 60% and most preferably of about 40%. The amount of open area is calculated on the basis of the total surface of the inner walls of the press chamber, when the press chamber is expanded to a maximum volume within the range of movement in which the press chamber remains in the closed position.

It has been observed that by providing tapered apertures whose cross-sectional area increases in the direction of water flow therethrough, the drainage of the container can be improved.

As embodied and broadly described herein, the invention also provides an apparatus for harvesting and dewatering peat moss material, the apparatus comprising:

a carrier vehicle;

a movable boom mounted to the carrier vehicle;

an attachment for harvesting and dewatering peat moss material mounted to the boom, the attachment comprising:

frame connected to the boom; and an apertured container mounted to the frame and defining a variable volume press chamber, the container being capable to assume an expanded position and a contracted position in order to expand and contract the press chamber respectively, in the expanded position the container being in an opened condition allowing ingress of peat moss material in the press chamber, in the contracted position the container being in a substantially closed condition preventing peat moss material to freely egress the press chamber and the press chamber having a significantly smaller volume than when the container is in the expanded position, whereby the boom is capable of manoeuvring the attachment for digging with the container in the expanded position peat moss material from a peat moss bed, consequent movement of the container toward the contracted position causing a significant volume reduction of the press chamber for expressing water from peat moss material, which is drained from the press chamber through apertures on the container.

As embodied and broadly described herein, the invention also provides a method for harvesting and dewatering peat moss material, the method comprising the steps of:

digging peat moss material with a bucket from a peat moss bed;

compressing the peat moss material while the peat moss material is in the bucket for expressing water therefrom; and draining from the bucket water expressed from the peat moss material.

DESCRIPTION OF A PREFERRED EMBODIMENT

The present invention provides an apparatus and a method for harvesting peat moss material for use in manufacturing fluid absorbent components of disposable absorbent products. The benefit of the invention over currently practiced harvesting techniques resides in the ability of dewatering the peat moss crop to reduce its weight for rendering more cost-effective its transportation and handling.

Figure 1:
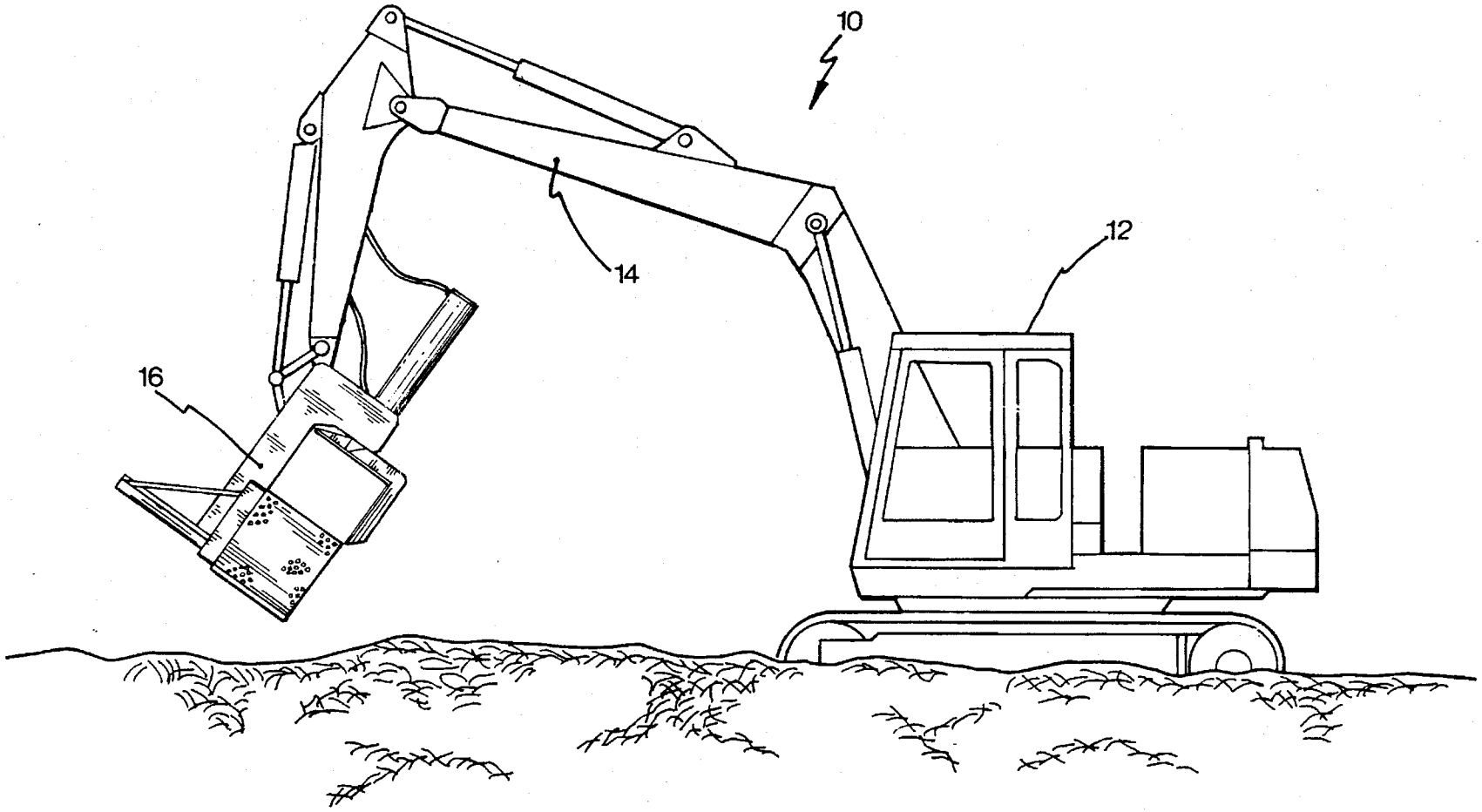
FIG. 1 is a side elevational view of an apparatus for harvesting and dewatering peat moss material constructed in accordance with the present invention.
Figure 2:
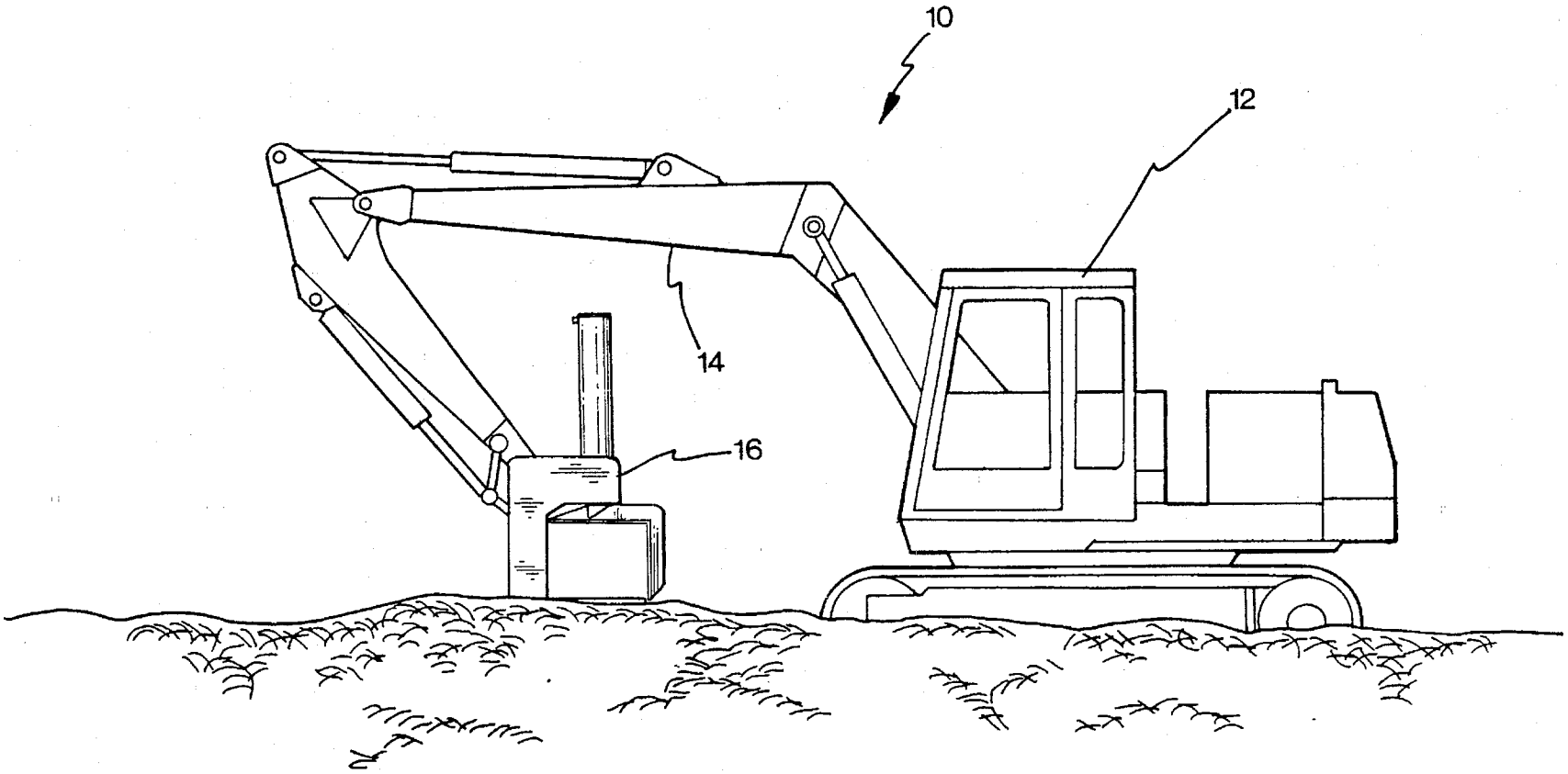
FIG. 2 depicts the apparatus shown in FIG. 1 in a different operating position.

With reference to the annexed drawings, more particularly to FIGS. 1 and 2, the apparatus according to the invention is designated comprehensively by the reference numeral 10 and comprises a conventional carrier vehicle 12 provided with an articulated boom 14 supporting a novel attachment 16 for harvesting and dewatering peat moss material. The articulated boom 14 allows to manoeuvre the attachment 16 into the desired position to harvest peat moss from the area surrounding the carrier vehicle 12.

The structure of the attachment 16 is best shown in FIGS. 3 to 9. The attachment 16 has a frame 18 made from metallic plates welded to one another to form a rigid supporting structure. At the lower end of the frame 18 is mounted an apertured bucket 20 defined by a horizontal bottom wall 22, upstanding and parallel side walls 24 and a vertical rear wall 26. An upstanding internal partition 28 divides the bucket 20 in two chambers 30 and 32 having identical dimensions.

A pair of rams 34 and 36 are mounted to the frame 18 above the bucket 20. Each ram comprises a horizontal pressure plate 38 and a vertical gate 40 depending from the front edge of the pressure plate 38, forming an inverted L-shaped structure. The rams 34 and 36 are movable vertically within the respective chambers 30 and 32 by respective actuators 42 and 44 mounted to the frame 18. In the example shown, the actuators are hydraulic rams, however, other fluid-operated piston cylinder assemblies may be used such as pneumatic cylinders for example. It may also be envisaged to employ mechanically or electrically powered devices, instead of fluid-operated actuators as it would be plain to a man skilled in the art.

The ram members 34 and 36 are spaced from one another by a distance slightly exceeding the thickness of the partition 28 to clear this partition during their descending movement within the respective chambers 30 and 32.

The ram members 34 and 36 are provided with longitudinally and transversally extending stiffening ribs 41 to rigidify their structure for preventing excessive deflection when the rams exert a considerable amount of pressure on peat moss in the bucket 20.

A pair of ejector assemblies 46 and 48 are provided in the chambers 30 and 32, respectively. Each ejector assembly comprises a hydraulic ram mounted at the rear of the bucket 20, having a piston rod which projects across the respective chamber when it is in the extended condition. At the end of the piston rods are formed rectangular ejection plates 50 slotted at lateral ends to slidingly receive guiding projections 52 formed on the sidewalls 24 and on the partition 28.

Instead of hydraulic rams, the ejector assemblies 46 and 48 may utilize pneumatic cylinders or, mechanically or electrically powered devices.

The bucket 20 and the ram members 34 and 36 define together an apertured container suitable for digging peat moss material from a peat moss bed, which can be contracted for expressing water from the peat moss material gathered therein. In order to discharge from the container water released from the peat moss material, a multiplicity of drainage apertures 54 are provided on the bucket 20 and on the rams 34 and 36. Most preferably, the apertures 54 are distributed uniformly on all sides of the bucket and on the pressure plate 38 and the gate 40 of each ram. Advantageously, the apertures 54 have an individual cross-sectional area in the range from about 0.32 square centimeters to about 2.85 square centimeters. Apertures substantially smaller than the minimum dimension may be clogged by peat moss fibers and will prevent water from draining. Apertures significantly larger than the maximum dimension may allow peat moss material to egress the container when it is being compressed. In a most preferred embodiment, the apertures 54 have an individual cross-sectional area of approximately 1.27 square centimeters and are spaced apart by a distance of approximately 1.91 centimeters. Circular apertures arranged into a staggered pattern are preferred, however other geometric figures, such as squares or rectangles, among others, are possible.

The collective dimension of the apertures 52 should be selected to provide on the container defined by the bucket 20 and the ram members 34 and 36 an open area in the range from about 25% to about 60% and most preferably of about 40%. The open area is the ratio between the total cross-sectional area defined by the apertures 54 and the internal surface of both chambers 30 and 32 (excluding the surface area of the partition 28) when the ram members 34 and 36 are in a partially extended position in which the lower edges of the gates 40 are at the level of the bottom wall 22 of the bucket 20. In this position the container is expanded to a maximum volume within the range of movement in which it remains closed by the rams 34 and 36. In the example shown, the internal surface of the chambers 30 and 32 would correspond to the inner surface area of both pressure plates 38, of both gates 40, of the bottom wall 22, of both upstanding walls 24 and of the rear wall 26.

Figure 7:
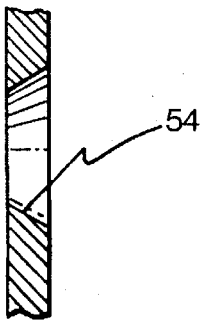
FIG. 7 is a cross-sectional view at a highly enlarged scale taken along lines 7—7 in FIG. 3.
Figure 8:
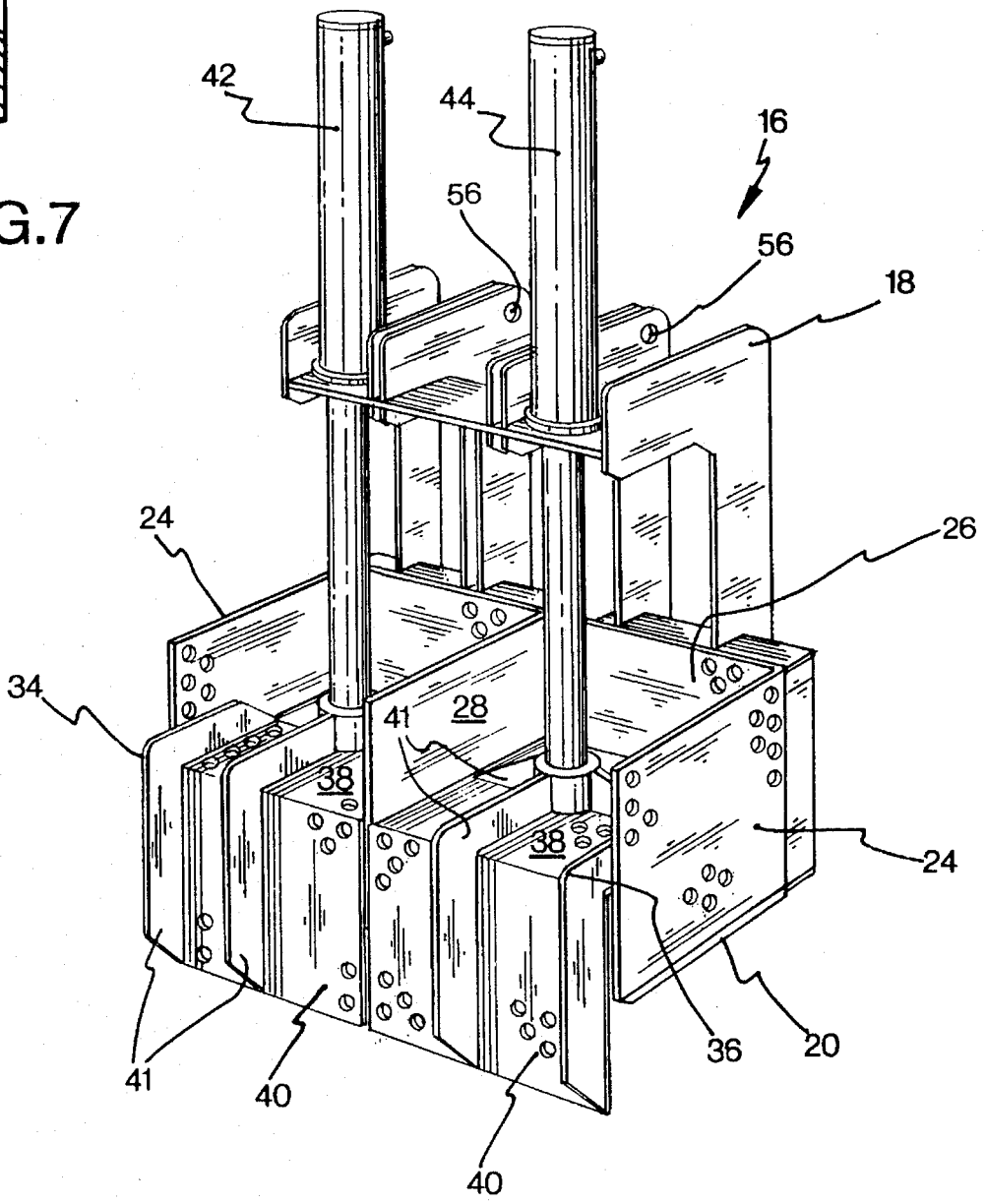
FIG. 8 is an isometric view of the attachment illustrated in FIG. 3, showing the ram member in the extended position for compressing and dewatering peat moss material.
Figure 9:
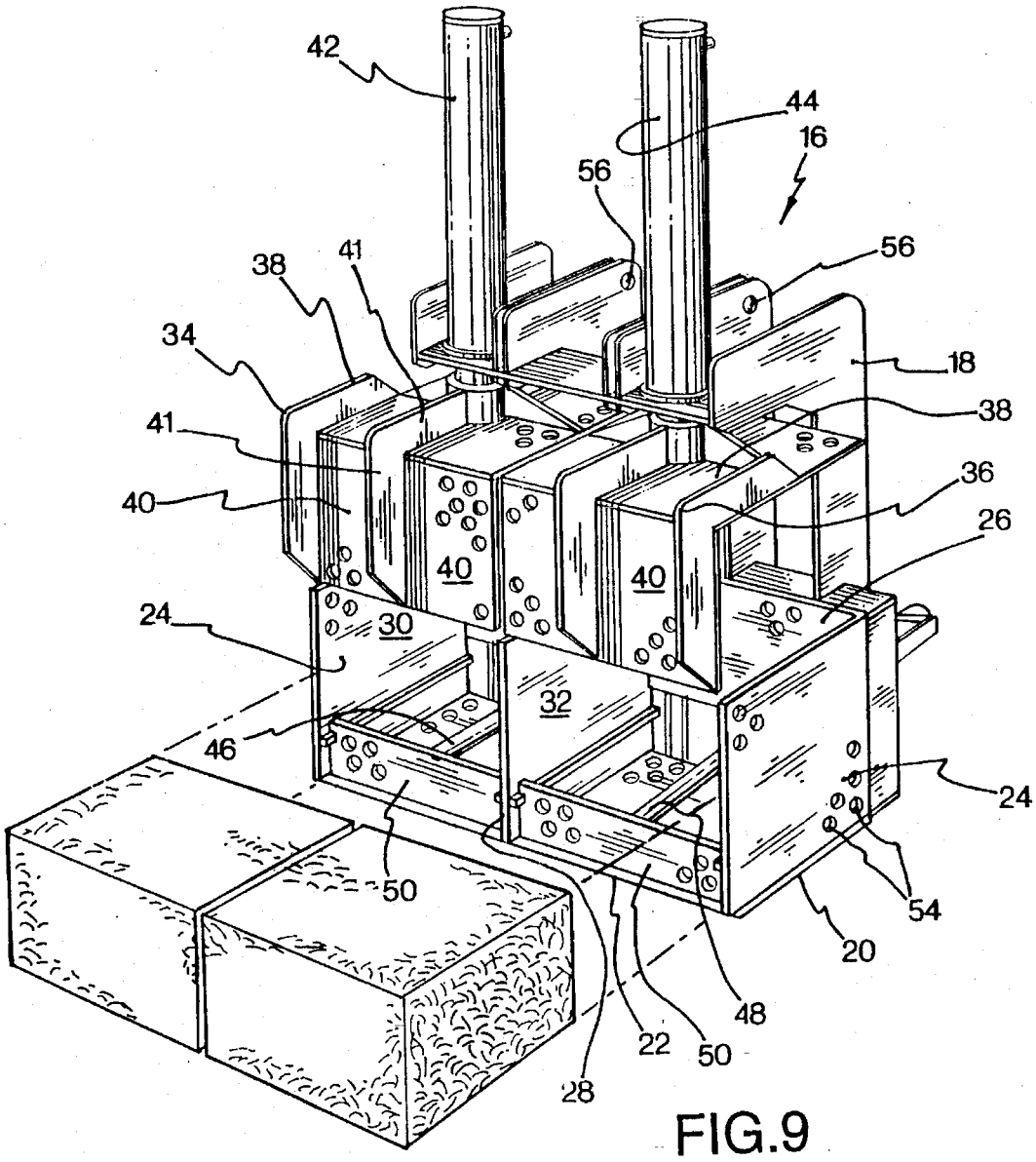
FIG. 9 illustrates the attachment shown in FIG. 3 in the opened position and the ejector assembly extended to drive out of the attachment a dewatered bale of peat moss material.
Figure 10:
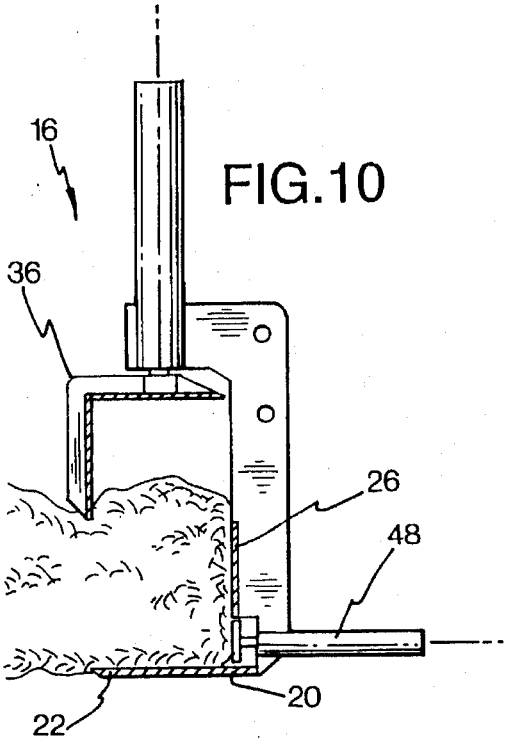
FIGS. 10 to 13 are cross-sectional views at a reduced scale of the attachment shown in FIG. 3, illustrating the attachment in various operating positions.

In a most preferred embodiment, the apertures 54 have a tapered configuration, whereby their cross-sectional area increases in the direction of water flow therethrough. This feature is best shown in FIG. 7. It has been observed that tapered apertures are less likely to become clogged by peat moss fibers. For the purpose of the present specification, the cross-sectional area of a tapered aperture for establishing the open area of the container or to determine if the aperture size falls in the preferred range, is measured at the narrowest point of the aperture.

Figure 5:
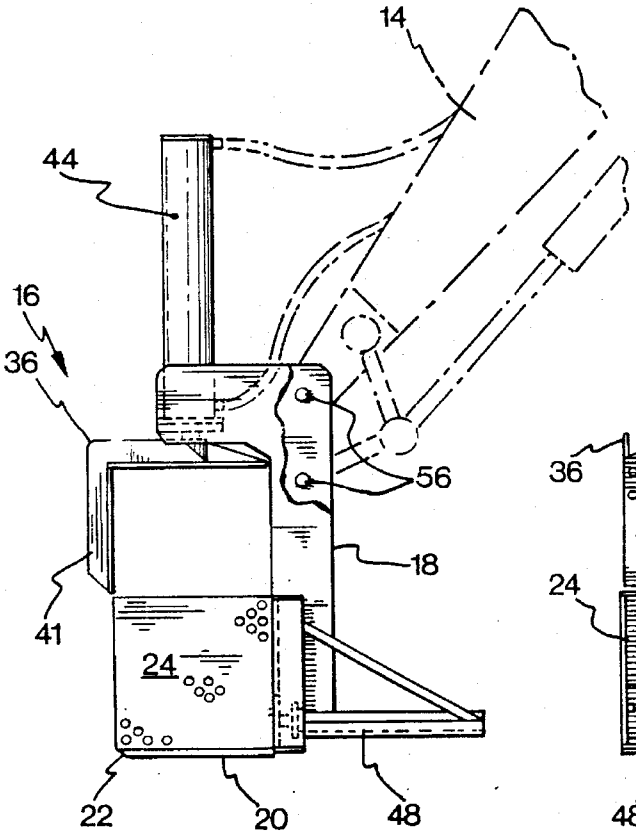
FIG. 5 is a side elevational, partly sectional view at a reduced scale of the attachment shown in FIG. 3, illustrating in dashed lines the articulated boom of a carrier vehicle connected to the attachment.
Figure 4:
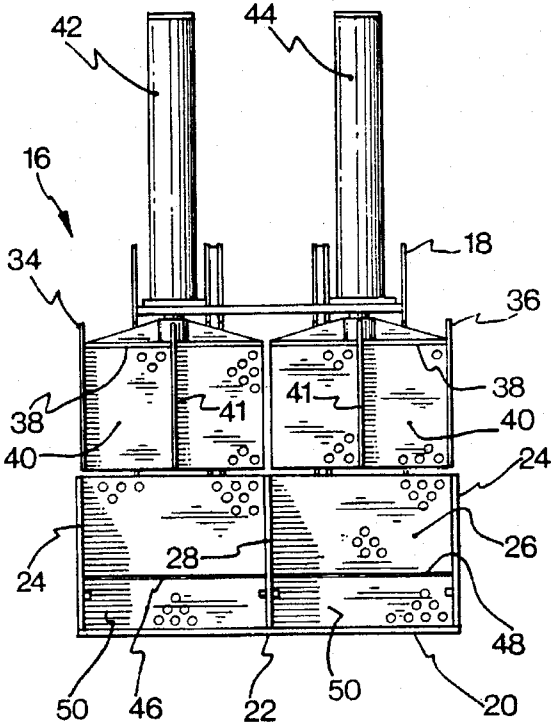
FIG. 4 is a front elevational view at a reduced scale of the attachment shown in FIG. 3.

The frame 18 is provided with connector holes 56 for connecting the attachment 16 to the free end of the articulated boom 14. This feature is best shown in FIG. 5. The number and location of the connector holes 56 will depend upon the specific boom design. To mount the attachment 16 to the boom 14, the free extremity of the boom 14 which is also provided with connector apertures is mated to the attachment, whereby all the connector apertures are in alignment. The assembly is secured by bolts. In addition, the hydraulic rams of the actuators 42 and 44 and of the ejector assemblies 46 and 48 are connected to the hydraulic circuit of the carrier vehicle 12.

The operation of the apparatus 10 is as follows. Once the carrier vehicle 12 is brought to the desired position in the peat moss bed, the boom 14 is maneuvered for digging peat moss material, as best shown in FIGS. 1 and 2, from strata having a modified VON POST value from H-1 to H-3 inclusive, which is the most suitable for manufacturing absorbent components for disposable absorbent products. During this operation, the actuators 42 and 44 are fully contracted in order to maintain the ram members 34 and 36 above the bucket 20 to clear its entry opening and allow peat moss material to enter in the chambers 30 and 32.

Figure 11:
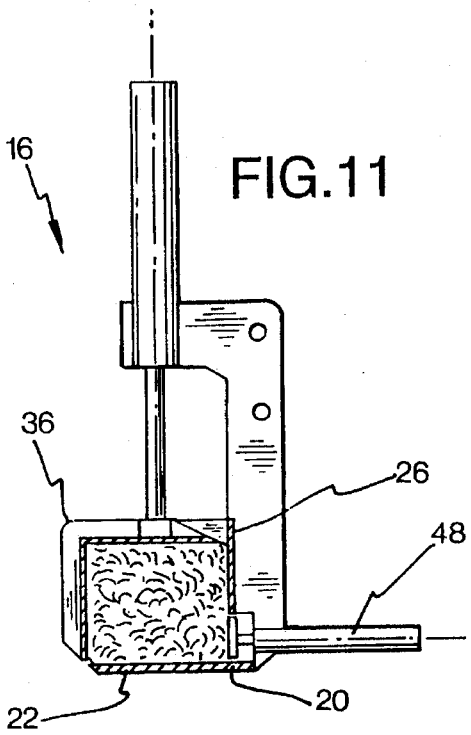

When the bucket is filled with peat moss material, the actuators 42 and 44 are extended to advance the rams 34 and 36 toward the bucket 20. During this downward movement the lower horizontal edges of the gates 40 and the front edge of the bottom wall 22 cooperate and act as opposing blades in order to shear the peat moss material which extends across the entry opening of the bucket 20, thereby freeing the load of peat moss material received in the bucket 20 from the adjoining vegetation. This feature is best shown in FIG. 11. The cutting action is completed when the lower edges of the gates 40 are at the level of the front edge of the bottom wall 22 and the pressure plates 38 are level with the top horizontal edges of the sidewalls 24. In this position, the ram members 34 and 36 shut the entry opening of the bucket 20 and close the chambers 30 and 32. Further extension of the ram members 34 and 36 causes a significant reduction of the volume of the chambers 30 and 32 by comparison to their condition shown in FIG. 11, thereby expressing water from the peat moss material. The water is drained from the chambers 30 and 32 through the apertures 54. In the fully extended position, shown in FIG. 12, the pressure plates 38 are approximately at the level of the ejector plates 50. In this position the volume of the chambers 30 and 32 is approximately three times less than their volume immediately after the rams 34 and 36 have closed the bucket 20. It should be noted that during the compaction stroke, the ram members 34 and 36 reduce the internal volume of the apertured container to dewater the peat moss material while maintaining the container closed for preventing the peat moss material thereof from being discharged outside.

It should be appreciated that the movement of the rams 34 and 36 with respect to the bucket 20 is a continuous motion, therefore the passage through the various phases of the compression cycle is accomplished in a progressive and gradual fashion.

Figure 3:
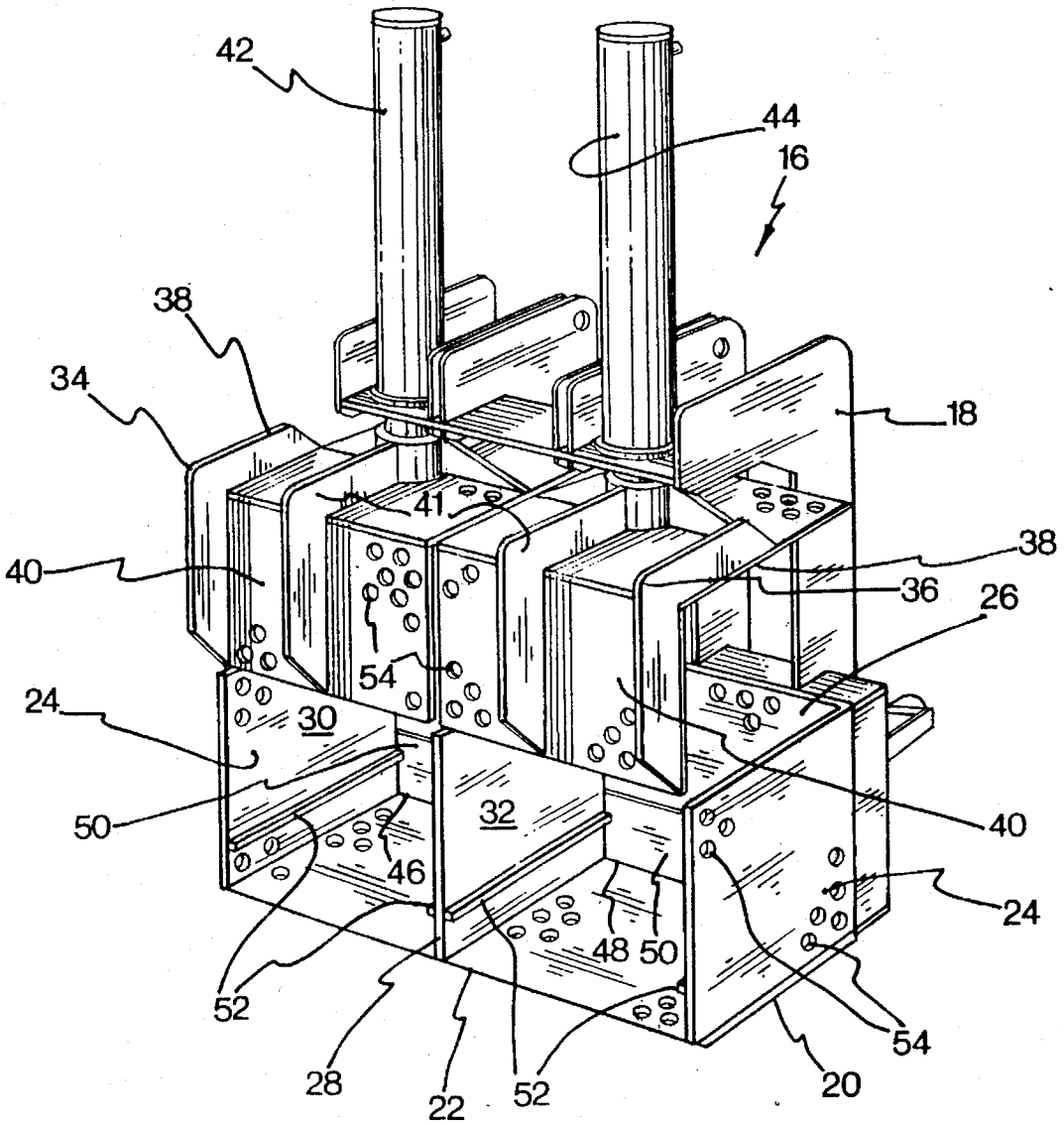
FIG. 3 is an enlarged isometric view of the attachment of the apparatus shown in FIGS. 1 and 2 for harvesting and dewatering peat moss material.
Figure 6:
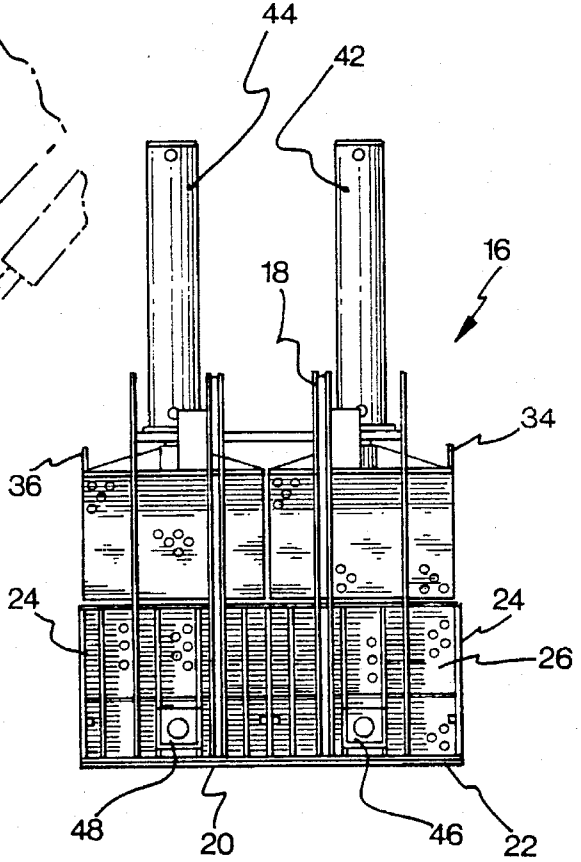
FIG. 6 is a rear elevational view at a reduced scale of the attachment shown in FIG. 3.
Figure 12:
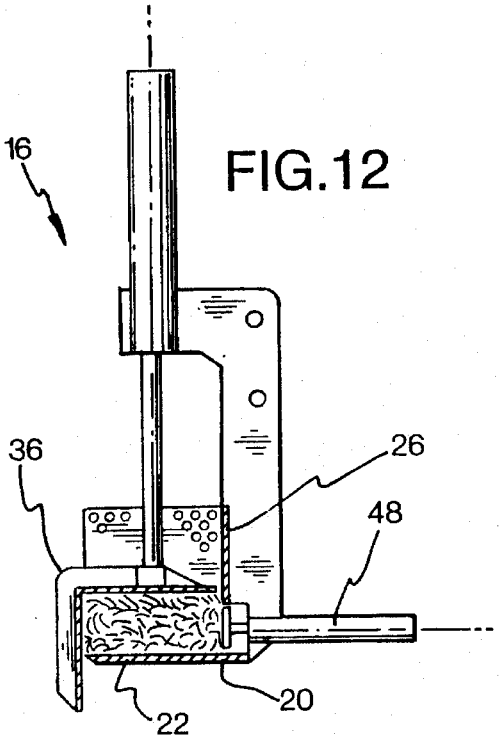
Figure 13:
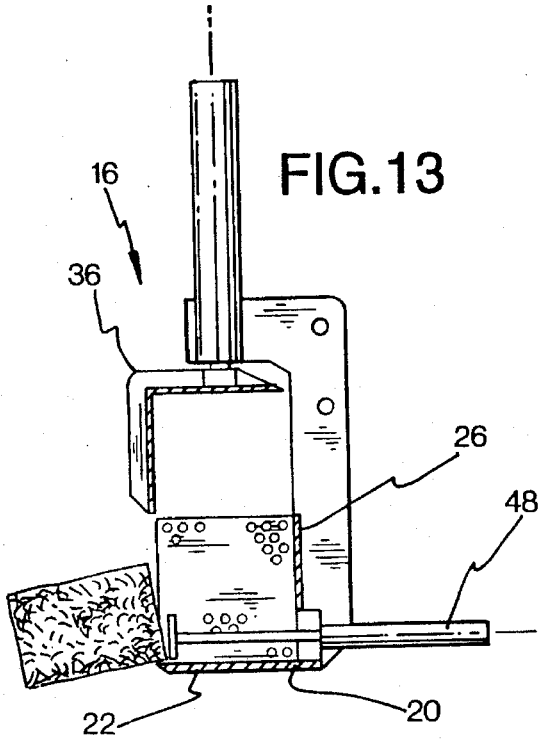

When the compression cycle is completed, the rams 34 and 36 are fully retracted to the position shown in FIGS. 3 and 12. The ejector assemblies 46 and 48 are then actuated simultaneously in order to drive the bales of peat moss material out of the bucket 20. The ejector assemblies are then retracted and the apparatus 10 is ready to accomplish a new harvesting and dewatering cycle.

In a specific example, the chambers 30 and 32 have a collective volume of 0.32 cubic meters (the ram members 34 and 36 being in the position shown in FIG. 11). A load of peat moss material completely filling both chambers and having a water content of approximately 90% weights about 153 kilograms. By compressing the peat moss material, the resulting dual bale has a weight of 80 kilograms and a volume of approximately 0.15 cubic meters. As it appears from this example, the compression of the peat moss material allows to reduce its weight and its size approximately by half.

The scope of the present invention is not limited by the description, examples and suggestive uses herein, as modifications can be made without departing from the spirit of the invention. Thus it is intended that the present application covers the modifications and variations of this invention provided that they come within the scope of the appended claims and their equivalents.

The embodiments of the invention in which an exclusive property or privilege is claimed are defined as follows:

1. An apparatus for harvesting and dewatering peat moss, the apparatus comprising;

a carrier vehicle;

a movable boom mounted to the carrier vehicle;

an attachment for harvesting and dewatering peat moss mounted to the boom, the attachment comprising:

a frame connected to the boom; and an apertured container mounted to the frame and defining a variable volume press chamber, the apertured container further comprising a bucket member and a ram member which form cooperating opposing blades;

the bucket member further comprising a horizontal bottom wall, upstanding and parallel side walls, a vertical rear wall, and a front entry opening, said bucket member being stationary with relation to the frame;

the ram member further comprising a horizontal pressure plate, which forms a horizontal top wall to said bucket member, and a vertical gate depending from a front edge of the horizontal pressure plate forming an inverted L-shaped structure;

the ram member being movable vertically within the variable volume press chamber of the apertured container; the apertured container having an expanded position and a contracted position in the expanded position the apertured container being in an opened condition allowing ingress of peat moss in the press chamber, in the contracted position the apertured container being in a substantially closed condition preventing egress of the peat moss from the press chamber and the press chamber having significantly smaller volume than when the apertured container is in the expanded position, whereby the boom moves the apertured container relative to a peat moss bed causing peat moss to enter into the apertured container through the front entry opening in the bucket member when the apertured container is in the opened condition, consequent movement of the container toward the contracted position causing a significant volume reduction of the press chamber for expressing water from the peat moss therein, which is drained from the press chamber through apertures on the apertured container.

2. An apparatus for harvesting and dewatering peat moss material as defined in claim 1, wherein said members define a shearing assembly for cutting peat moss material extending across an entry opening of said container.

3. An apparatus for harvesting and dewatering peat moss material as defined in claim 1, comprising an ejector assembly mounted to said supporting structure for driving out of compressed and dewatered peat moss.

4. An apparatus for harvesting and dewatering peat moss material as defined in claim 1, wherein said apertures have an individual cross-sectional area in the range from about 0.32 square centimeters to about 2.85 square centimeters.

5. A method for harvesting and dewatering peat moss, said method comprising the steps of:

digging peat moss from a peat moss bed with the apparatus according to claim 1;

compressing the peat moss while the peat moss is in said bucket member for expressing water therefrom; and draining water expressed from the peat moss from said bucket member.

6. A method for harvesting and dewatering peat moss as defined in claim 5, comprising the step of digging peat moss having a modified VON POST value in the range from about H-1 to about H-3.

7. A method for harvesting and dewatering peat moss as defined in claim 5, comprising the step of substantially closing said apertured container while compressing the peat moss therein for preventing the peat moss to egress said bucket.

8. A method for harvesting and dewatering peat moss as defined in claim 5, comprising the step of extending said ram member within said bucket member for compressing the peat moss therein.

9. A method for harvesting and dewatering peat moss as defined in claim 8, comprising the step of cutting said peat moss projecting out of said bucket member with said ram member while extending said ram member for compressing the peat moss in said bucket member.

10. A method for harvesting and dewatering peat moss as defined in claim 5, comprising the step of ejecting the peat moss from said bucket member after compressing the peat moss therein.

11. A device for harvesting and dewatering peat moss, the device comprising:

a supporting structure capable of movement;

an apertured container mounted to said supporting structure and which further comprises a bucket member and a ram member which form cooperating opposing blades;

the bucket member further comprising a horizontal bottom wall, upstanding and parallel side walls, a vertical rear wall, and a front entry opening, said bucket member being stationary with relation to the supporting structure;

the ram member further comprising a horizontal pressure plate, which forms a horizontal top wall to said bucket member, and a vertical gate depending from a front edge of the horizontal pressure plate forming an inverted L-shaped structure;

the ram member being movable vertically to define a variable volume press chamber which is capable of assuming an expanded position and a contracted position;

in the expanded position the apertured container is in an opened condition allowing ingress of peat moss in the press chamber through the front entry opening of the bucket member;

in the contracted position, the apertured container is in a substantially closed condition preventing peat moss from egressing the press chamber, the opposing blades formed from the bucket member and the ram member shearing the peat moss extending across the front entry opening of the bucket member and the horizontal pressure plate compressing the peat moss in the press chamber to express water from the peat moss through the apertures in the apertured container.

12. A device for harvesting and dewatering peat moss as defined as claim 11, further comprising an ejector assembly mounted to the rear vertical wall of the bucket member which, upon change of the apertured container from a contracted position to an expanded position, the ejector assembly drives out of the container the compressed and dewatered peat moss.

13. A device for harvesting and dewatering peat moss material as defined in claim 12, wherein said ejector assembly comprises a projecting member selectively movable across said press chamber for driving compressed and dewatered peat moss material out of said container through the opening of said container.

14. A device for harvesting and dewatering peat moss material as defined in claim 13, wherein said ejector assembly comprises a fluid-operated piston-cylinder assembly having a piston rod selectively extendable to move said projecting member across said press chamber for driving compressed and dewatered peat moss material out of said container through said opening.

15. A device for harvesting and dewatering peat moss material as defined in claim 11, wherein said press chamber is capable of being contracted while said container is maintained in said substantially closed condition.

16. A device for harvesting and dewatering peat moss material as defined in claim 11, comprising a plurality of ejector assemblies mounted to said supporting structure for driving compressed and dewatered peat moss material out of said container through the opening thereof.

17. A device for harvesting and dewatering peat moss material as defined in claim 11, wherein said apertures have an individual cross-sectional area in the range from about 0.32 square centimeters to about 2.85 square centimeters.

18. A device for harvesting and dewatering peat moss material as defined in claim 11, wherein said apertures have a cross-sectional area which increases in a direction of water flow therethrough.

19. A device for harvesting and dewatering peat moss material as defined in claim 11, comprising a plurality of ram members.

20. A device for harvesting and dewatering peat moss material as defined in claim 11, comprising an actuator for moving said ram member between said expanded and said contracted positions.

21. A device for harvesting and dewatering peat moss material as defined in claim 20, wherein said actuator comprises a fluid-operated piston-cylinder assembly.

22. A device for harvesting and dewatering peat moss material as defined in claim 20, wherein said actuator comprises a hydraulic ram.

23. A device for harvesting and dewatering peat moss material as defined in claim 11, wherein said supporting structure includes connecting means for attaching said device to an articulated boom of a carrier vehicle.

* * * * *